US007859380B2

(12) United States Patent
Hasenour et al.

(10) Patent No.: US 7,859,380 B2
(45) Date of Patent: Dec. 28, 2010

(54) BOBBIN ASSEMBLY

(75) Inventors: Tim Hasenour, Clemmons, NC (US); Dan Johnson, Kernersville, NC (US); Kurt T. Zarbock, Advance, NC (US)

(73) Assignee: Tyco Electronics Corporation, Middletown, PA (US)

( * ) Notice: Subject to any disclaimer, the term of this patent is extended or adjusted under 35 U.S.C. 154(b) by 224 days.

(21) Appl. No.: 12/027,485

(22) Filed: Feb. 7, 2008

(65) Prior Publication Data

US 2009/0201114 A1 Aug. 13, 2009

(51) Int. Cl.
*H01F 27/30* (2006.01)

(52) U.S. Cl. ..... 336/198

(58) Field of Classification Search ..... 336/65, 336/83, 192, 200, 232, 198; 257/531
See application file for complete search history.

(56) References Cited

U.S. PATENT DOCUMENTS 3,162,830 A 12/1964 Zack et al.
3,354,417 A 11/1967 Davis
3,605,055 A 9/1971 Grady
3,750,073 A * 7/1973 Okano ..... 336/198
3,824,519 A * 7/1974 Miller ..... 336/192
4,000,483 A * 12/1976 Cook et al. ..... 336/98
4,166,265 A 8/1979 Reynolds et al.
4,636,763 A 1/1987 Nabstedt et al.
4,730,178 A 3/1988 Gunnels et al.
5,321,572 A 6/1994 Shibui et al.
6,344,787 B1 2/2002 McGrane et al.
6,598,824 B2 * 7/2003 Schmidt ..... 242/603
6,630,880 B2 * 10/2003 Cheung et al. ..... 336/198
7,154,366 B2 * 12/2006 Hsueh et al. ..... 336/198

* cited by examiner

*Primary Examiner*—Tuyen Nguyen

(57) ABSTRACT

A bobbin assembly is disclosed that includes a first bobbin and a second bobbin. The second bobbin is configured substantially similar to the first bobbin. The first and second bobbins include a first flange and a second flange disposed at opposite ends of a central core. The first flanges include terminal receiving cavities and wire posts for terminate a wire wound around the central core. The bobbin assembly may be formed by mating either the first flanges or the second flanges together.

9 Claims, 3 Drawing Sheets

BOBBIN ASSEMBLY

FIELD OF THE INVENTION

The present invention relates generally to bobbins for inductive devices. More specifically, the present invention relates to a bobbin assembly having two cooperating bobbins.

BACKGROUND OF THE INVENTION

An inductive device typically includes a wire winding surrounding a common core of a bobbin. The bobbin may be provided with leads or terminals to which the ends of the winding wire are terminated. The winding wire, termed "magnetic wire", induces a magnetic field when voltage is applied. In some applications, it is necessary to wind two separate windings on a single bobbin. The windings may be formed on the bobbin concentrically or side by side. When two windings are provided on the bobbin, one winding is referred to as the primary winding, and the other winding is provided as the secondary winding. After the bobbin is provided with windings, the wound bobbin is usually not modifiable, and thus limited in application.

Therefore, there is an unmet need to provide a bobbin having a flexible construction that allows for modifiable combinations of windings. The bobbin should allow for pre-wound combinations of windings that enable the bobbin to be modifiable for various applications.

SUMMARY OF THE INVENTION

In a first exemplary embodiment of the invention, a split bobbin is disclosed that includes.

Further aspects of the method and system are disclosed herein. The features as discussed above, as well as other features and advantages of the present invention will be appreciated and understood by those skilled in the art from the following detailed description and drawings.

BRIEF DESCRIPTION OF THE DRAWINGS

Wherever possible, the same reference numbers will be used throughout the drawings to refer to the same or like parts.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiments set forth herein; rather, these embodiments are provided so that this disclosure will be thorough and complete and will fully convey the scope of the invention to those skilled in the art.

Figure 2:
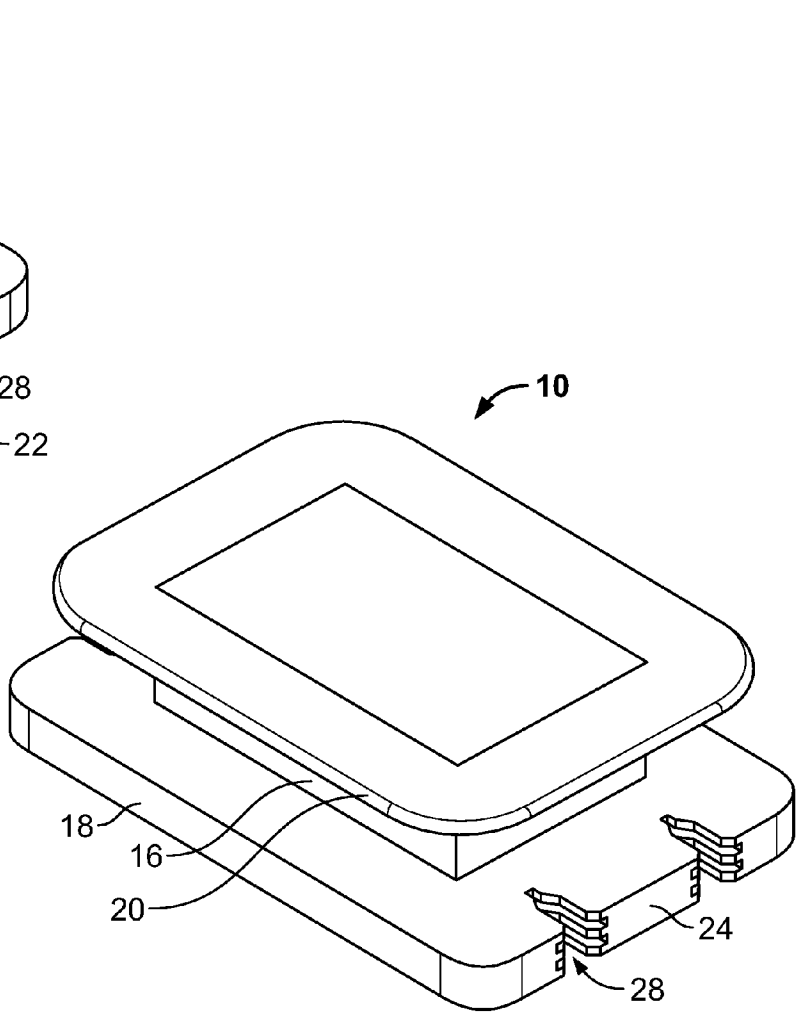
FIG. 2 illustrates a rotated bottom perspective view of the exemplary bobbin of FIG. 1.
Figure 1:
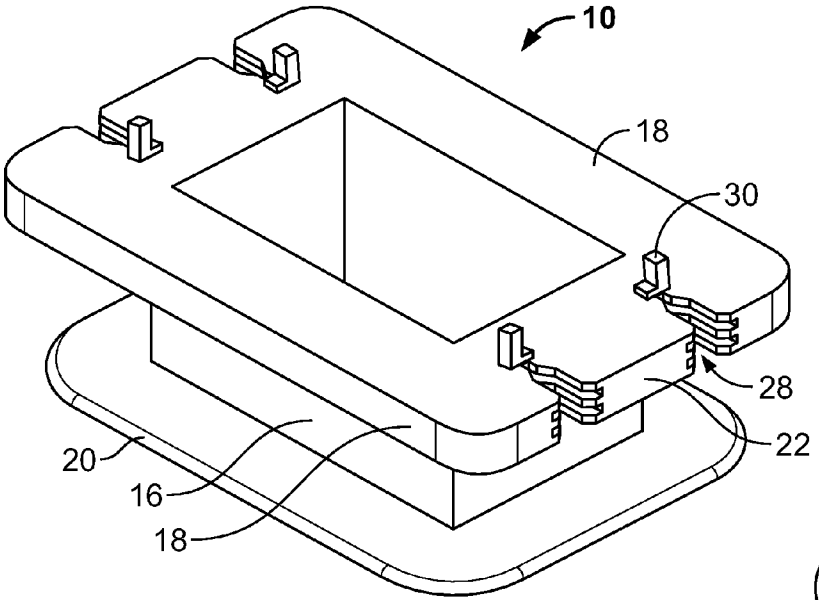
FIG. 1 illustrates a top perspective view of an exemplary bobbin according to an embodiment of the invention.

A top and rotated bottom view of an exemplary embodiment of a bobbin 10 is shown in FIGS. 1 and 2, respectively. The bobbin 10 may be formed of any suitable thermoplastic material, such as thermoplastic nylon. Additional embodiments of exemplified bobbins according to this invention may similarly be formed of any suitable thermoplastic material.

The bobbin 10 includes a first flange 18 and a second flange 20 disposed at opposite ends of the central core 16 as shown in FIGS. 1 and 2. The central core 16 and flanges 18, 20 are here shown as rectangular, however, it will be readily understood that the particular shape is illustrative only, and any appropriate shape including square and round may be used.

The first flange 18 includes terminal receiving cavities 28 and wire termination posts 30. The cavities 28 are disposed in a first side surface 22 and second side surface 24. The first and second side surfaces 22, 24 are located opposite one another on the first flange 18 as shown. The posts 30 are disposed on a top surface 26 of the first flange 18. A post 30 is associated with a corresponding cavity 28 as shown in FIG. 1. In this exemplary embodiment, two cavities 21 and two corresponding posts 30 are disposed in each side surface 22, 24. However, more than two cavities may be present on each side surface 22, 24 to provide flexibility in terminal positioning or to allow more than two terminals to be used, for example, when a winding tap (not shown) is included.

The cavities 28 having received appropriate wire terminals (not shown) and posts 30 are configured to terminate the ends of a wire (not shown), which has been wound around the core 16. The cavities 28 are configured to receive a wire terminal, such as a MagMate® wire terminal produced by TYCO Electronics Corporation of Wilmington, Del.

To pre-build a wound bobbin, a first end of the wire is initially terminated at a post 30, passed through the corresponding cavity 28 and wound around the core 16. After a predetermined amount of wire is wound around the core 16 as is known in the art, the wire is passed through another cavity 28 and tied off, twisted, or otherwise secured to another corresponding post 30. The particular cavities 28 and posts 30 selected for terminating the ends of the wire are determined by the application of the wound bobbin. A wire terminal (not shown) is then inserted into the cavities 28 having the wires passed through to engage and terminate the wires. The wire between the terminal and the post 30 where the wire is secured may then be removed, for example by cutting the wire proximate to the terminal. The post 30 is then removed. This configuration of cavities 28 and posts 30 provides for winding a bobbin 10 and terminating the winding at the posts 30 at one particular time and place, and at a later time and place, loading terminals for a particular application into the cavities 28.

Figure 3:
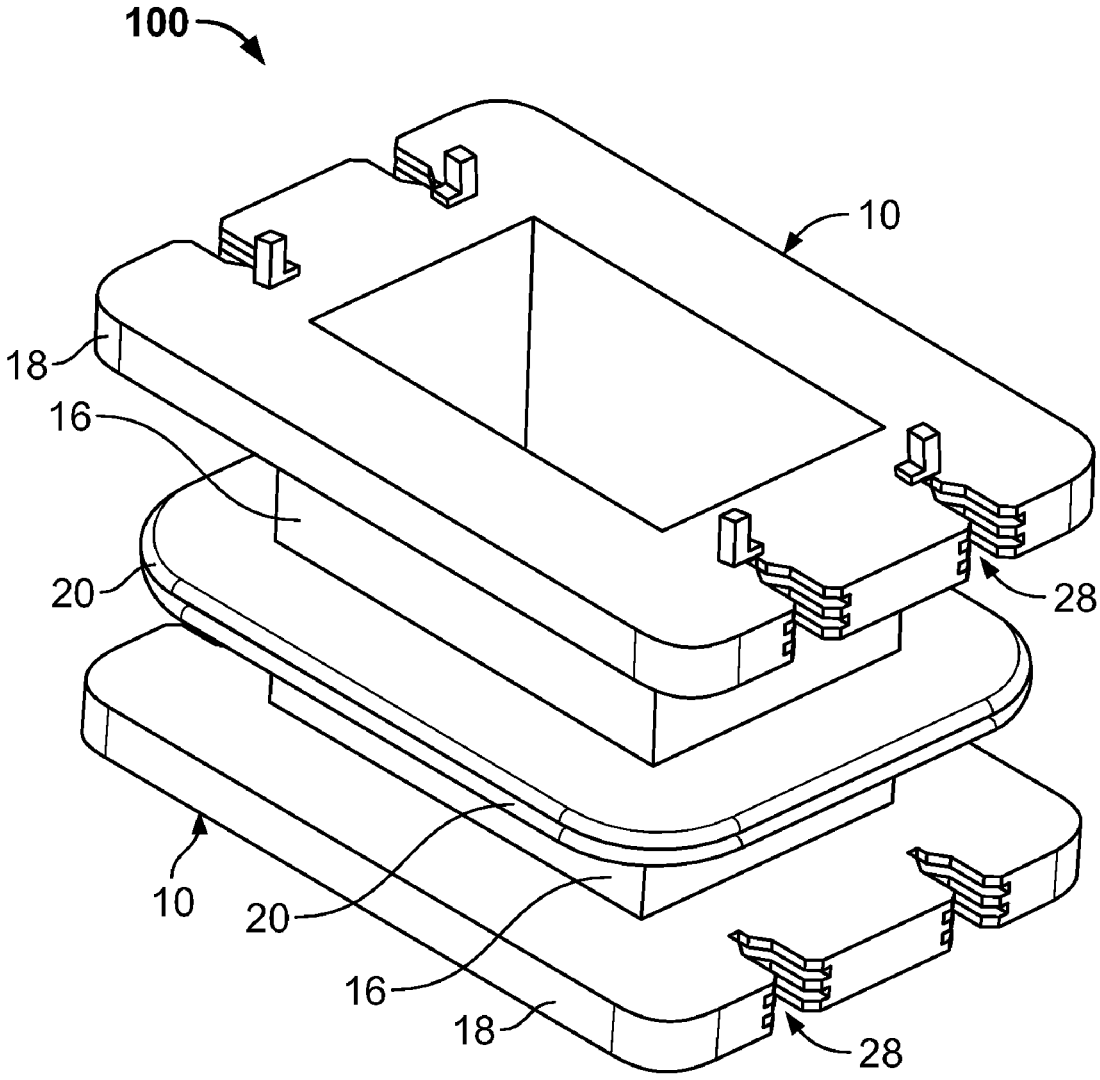
FIG. 3 illustrates both a top perspective view and a bottom perspective view of an exemplary bobbin assembly formed by assembling two exemplary hermaphroditic bobbins according to the invention.

FIG. 3 shows both a top and a bottom view of an exemplary embodiment of a bobbin assembly 100. The bobbin assembly 100 includes two substantially identical bobbins 10, as previously discussed above, mated by contacting the second flange 20 of each bobbin 10 to form the assembly 100. Since the bobbins 10 are substantially identical, FIG. 3 shows the substantially identical top and bottom views thereof.

In an alternatively configuration of the bobbin assembly 100 (not shown), the first flanges 18 are mated after the bobbins 10 have been wound with a winding wire, the winding wire has been terminated as described above, and the posts 30 have been removed, to form an alternative configuration of the bobbin assembly 100.

For a particular application, the bobbins 10 may be provided with windings and terminals to meet the performance characteristics required for the particular application. The applied windings for each bobbin 10 may have similar or different performance characteristics. Alternatively, wound bobbins may be selected from a group of pre-wound bobbins, and terminals selected and installed to meet the performance characteristics required for the particular application. The wound bobbin assembly is held in a mated position by an inductor core surrounding the wound bobbin assembly as is known in the art. The inductor core may be solid or formed of laminations, and may be of varying geometry, as is also generally well known in the art.

Figure 4:
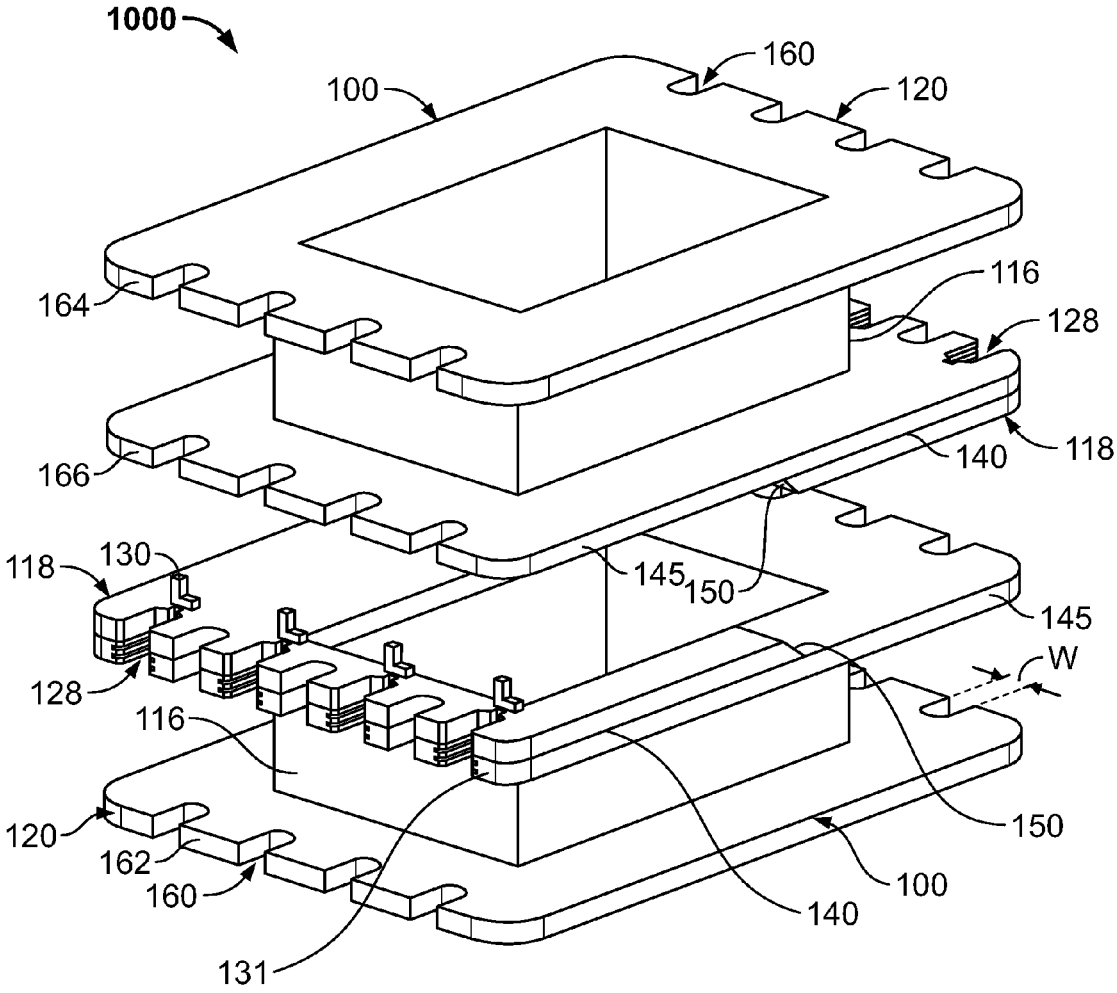
FIG. 4 illustrates an perspective view of another exemplary bobbin assembly before mating according to an embodiment of the invention.

A view of another exemplary embodiment of a bobbin assembly 1000 before the wire posts 128 are removed and the assembly 1000 is mated is shown in FIG. 4. As can be seen in FIG. 4, the bobbin assembly 1000 includes two substantially similar bobbins 100. Each bobbin 100 includes a first flange 118 and a second flange 120 disposed at opposite ends of a central core 116. The central core 116 and first and second flanges 118, 120 are here shown as rectangular, it will be readily understood that the particular shape is illustrative only, and any appropriate shape may be used.

The first flange 118 includes terminal receiving cavities 128, corresponding wire posts 130 and wire support slots 160. The terminal receiving cavities 128 are disposed in a first side surface 131 of the first flange 118 as shown. A wire post 130 is associated with each cavity 128 as shown in FIG. 4. In this exemplary embodiment, four cavities 128 and corresponding posts 130 are disposed in the first side surface 131, however, it should be apparent that two or more cavities 128 and corresponding posts 130 may be included to provide flexibility in terminal positioning. The cavities 128 are configured to receive wire terminals (not shown). The cavities 128 having received terminals (not shown) and posts 130 are configured to terminate the ends of a wire winding (not shown) that has been wound around the core 116 in a manner similar to the exemplary embodiment discussed above.

As can further be seen in FIG. 4, the first flange 118 includes a first section 140, a second section 145 and a step 150 disposed there between. The first section 140 has a thickness selected to provide for the inclusion of cavities 128. The second section 145 has a thickness less than the thickness of the first section 140. The step 150 divides the first flanges 118 into approximately equal first and second sections 140, 145, so that the first flanges 118 of the two bobbins 100 can be mated to form the bobbin assembly 1000. The step 150 assists in aligning two pre-wound bobbins together during assembly of a wound bobbin assembly. Alternatively, the first flanges 118 may have a uniform thickness.

In an alternatively configuration of the bobbin assembly 1000 (not shown), one or both of the second flanges 120 may be used to mate the bobbins 100 together. In this alternative configuration, the first flanges 118 may be provided with a uniform thickness.

As can further be seen in FIG. 4, the first and second flanges 118, 120 include wire support slots 160. Wire support slots 160 are disposed on a first side surface 162 and a second side surface 164 opposite the first side surface of the second flange 120, and on a second side surface 166 of the first flange 118. In this exemplary embodiment, the number of slots 160 on a given side surface correspond with the number of cavities 128 provided on the first flange 118. Wire support slots 160 have a width W. Width W is preferably selected to compress and secure a wire used to electrically connect terminals of an assembled wound bobbin assembly to an inductive system. The slots 160 of the first flange 118 are configured on the second side surface 166 to align with the cavities 128 of the mating bobbin 100.

As in the prior embodiment, each bobbin 100 may be pre-wound and provided with terminals as described above to provide a wound bobbin assembly as required for a particular application.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A bobbin assembly for use in a inductive device, comprising:

a first bobbin comprising a first flange, a second flange, and a central core disposed therebetween;

the first flange comprising terminal receiving cavities disposed in a first side surface of the first flange, the terminal receiving cavities configured to receive and secure wires and wire terminals in the first side surface for terminating the ends of a magnetic wire wound around the central core;

a second bobbin configured substantially similarly as the first bobbin and comprising a first flange, a second flange, and a central core disposed therebetween, the first flange comprising terminal receiving cavities disposed in a first side surface of the first flange, the terminal receiving cavities configured to receive and secure wires and wire terminals in the first side surface for terminating the ends of a magnetic wire wound around the central core;

wherein the first bobbin and the second bobbin are mated to form the bobbin assembly;

and wherein the fist bobbin and second bobbin have substantially identical top and bottom surfaces.

2. The assembly of claim 1, further comprising terminal receiving cavities disposed in a second side surface of the first flange of the first bobbin and the first flange of the second bobbin.

3. The assembly of claim 1, wherein the bobbin assembly is formed by mating the second flange of the first bobbin with the second flange of the second bobbin.

4. The assembly of claim 1, wherein the bobbin assembly is formed by mating the first flange of the first bobbin with the first flange of the second bobbin.

5. The assembly of claim 4, wherein the first flange of the first bobbin and the first flange of the second bobbin both further include a first section having a first thickness that includes the terminal receiving cavities, a second section having a second thickness, the second thickness being less than the first thickness, and a step disposed between the first section and the second section.

6. The assembly of claim 1, wherein the first flange of the first bobbin and the first flange of the second bobbin have wire posts for terminating the ends of the magnetic wire wound around the central core of each bobbin that are removed prior to the first bobbin and the second bobbin being mated.

7. The assembly of claim 1, wherein the second flange of the first bobbin and the second bobbin comprises slots configured to secure wires for electrically connecting terminals disposed in the terminal receiving cavities to an inductive system.

8. The assembly of claim 1, further comprising:

a first wire winding wound around the central core of the first bobbin, the first wire winding have wire ends secured to posts on the first flange; and a second wire winding wound around the central core of the second bobbin, the second wire winding have wire ends secured to posts on the second flange.

9. The assembly of claim 1, further comprising:

a first wire winding wound around the central core of the first bobbin, the first wire winding having wire ends terminated at wire terminals received in the terminal receiving cavities of the first flange; and a second wire winding wound around the central core of the second bobbin, the second wire winding having wire ends terminated at wire terminals received in the terminal receiving cavities of the second flange.

* * * * *